US005660906A

United States Patent [19]

Hill

[11] Patent Number: 5,660,906

[45] Date of Patent: Aug. 26, 1997

[54] FLOOR COVERINGS

[75] Inventor: Maurice N. Hill, Queensbury, N.Y.

[73] Assignee: BTR PLC, London, England

[21] Appl. No.: 696,119

[22] Filed: Aug. 13, 1996

Related U.S. Application Data

[63] Continuation of Ser. No. 384,546, Feb. 7, 1995, abandoned.

[51] Int. Cl.[6] ..... B32B 3/02

[52] U.S. Cl. ..... 428/53; 428/57; 428/58; 428/62; 428/88; 428/89; 428/95; 15/215; 15/216; 15/217

[58] Field of Search ..... 428/53, 57, 58, 428/62, 88, 89, 95; 15/215, 216, 217

[56] References Cited

U.S. PATENT DOCUMENTS

| | | | |
|---|---|---|---|
| 2,800,688 | 7/1957 | Lobel | 15/215 |
| 4,381,324 | 4/1983 | Ellingson, Jr. | 428/62 |
| 4,408,365 | 10/1983 | Palmer . | |
| 4,568,587 | 2/1986 | Balzer | 428/58 |
| 5,157,804 | 10/1992 | Williams | 428/53 |

FOREIGN PATENT DOCUMENTS

| | | | |
|---|---|---|---|
| 315898 | 8/1929 | United Kingdom | 15/215 |
| 1055960 | 1/1967 | United Kingdom . | |
| 2080105 | 2/1982 | United Kingdom | 15/217 |
| 2090128 | 7/1982 | United Kingdom . | |
| 2258624 | 2/1993 | United Kingdom . | |
| 2268058 | 1/1994 | United Kingdom . | |
| 2032952 | 2/1994 | United Kingdom . | |
| 2280603 | 2/1995 | United Kingdom . | |
| 2284151 | 5/1995 | United Kingdom . | |

*Primary Examiner*—Terrel Morris

*Attorney, Agent, or Firm*—Watson Cole Stevens Davis, P.L.L.C.

[57] ABSTRACT

A floor covering comprises a plurality of tread strips of substantially resilient material, each tread strip having a wear layer of a material which provides a fibrous tread surface, and a plurality of spacer strips of substantially rigid material arranged interposed between the tread strips whereby each successive pair of tread strips is spaced apart by an assembly of at least two, typically three of said spacer strips arranged to lie side-by-side with connecting means passing through aligned apertures in the strips.

21 Claims, 2 Drawing Sheets

FLOOR COVERINGS

This application is a continuation of Ser. No. 08/384,546, filed Feb. 7, 1995 now abandoned.

This invention relates to a floor covering suitable for use as an entrance mat and to a method of manufacture of said floor covering.

BACKGROUND OF THE INVENTION

A floor covering for use as an entrance mat needs a heavily textured upwardly facing surface having wiper regions to remove dirt and moisture from footwear and recess regions to receive collected dirt pending periodic cleaning. One such type of floor covering in the form of an entrance mat is described in the assignees Patent Specification GB-A-2258624A. The mat comprises a plurality of first, spacer strips of substantially rigid material, for example of aluminum or a plastics material such as polyvinyl chloride or polypropylene, and a plurality of second, tread strips of substantially resilient and flexible material such as natural or synthetic rubber and which support a fibrous tread surface, the tread strips being interposed alternately between the spacer strips. The tread and spacer strips are secured together in side-by-side relationship by means of one or more connecting elements, such as wires, which pass through aligned apertures in the strips.

In the aforedescribed construction the fibrous tread surfaces of the tread strips serve primarily as wiper regions to support footwear passing thereover and perform a cleaning action whereas the recess regions provided by the spacer strips between respective neighbouring pairs of tread strips serve as collector grooves in which dirt may gather for subsequent removal during a mat cleaning operation.

Commonly the substantially rigid spacer strips are of an H-shape in cross-section with the cross piece of the H, in use, lying vertically in the direction of the thickness of the matting. Said cross piece is provided with apertures through which the connecting elements pass, and the edges of the side pieces of the H formation abut adjacent tread strips. Alternatively they are commonly of half an H shape, i.e. a C type shape as described in our Patent Specification GB-A-2090128A.

Conventionally each tread strip has an embedded reinforcement of one or more layers of fabric arranged to lie substantially transverse to the plane of the mat. The surface of the rubber or like substantially resilient material is removed from a face of the strip which is to define the tread surface so as to expose the fibres and provide a fibrous tread surface. The embedded reinforcement provides the strip with a good degree of stiffness so that it resists deformation when subject to load.

The resulting mat with a fibrous tread surface as descried in the preceding paragraph is found to exhibit excellent wear characteristics even in conditions of arduous use, and to remain effective in providing a cleaning action. However although the construction of the tread strips with an embedded reinforcement contributes to excellent wear characteristics, that material is expensive.

In some installations at which an entrance mat normally will be exposed to only lightly soiled footwear it may be acceptable to provide that the proportion of the mat surface which is comprised by the tread strips is less than usual and thereby reduce the proportion of the relatively expensive tread strips.

Theoretically the proportion of surface area comprised by the tread strips could be reduced by reducing the width of each tread strip to less than is conventional. In practice, however, any significant reduction in width will result in the mat having an unsatisfactory feel when walked on. Also the machinery used to manufacture standard width strips would need modification to manufacture strips of a narrower width. In consequence the economies of scale would be diminished.

The proportion of the mat surface area comprised by the tread strips in theory might alternatively be reduced by increasing the width of the spacer strips. In practice, however, difficulties arise in producing an extruded strip of greater width without increasing its thickness. Also the visual appearance of the mat generally may suffer because of the presence of a greater proportion of area occupied by the spacer strips.

SUMMARY OF THE INVENTION

An object of the present invention is to provide a floor covering which is relatively economical in the use of materials.

In one of its aspects the present invention provides a floor covering comprising a plurality of tread strips of substantially resilient material each of which tread strips has a wear layer of a material which provides a fibrous tread surface, and a plurality of spacer strips of substantially rigid material arranged interposed between the tread strips whereby each successive pair of tread strips is spaced apart by an assembly of at least two of said spacer strips arranged side-by-side and the pluralities of strips being secured together in side-by-side relationship by connecting means which pass through aligned apertures in the strips.

In contrast to a conventional construction in which 50% of a mat surface is comprised by spacer strips, in a floor covering of the present invention it is envisaged that preferably between 55% and 75%, but more preferably not more than 70%, of the area of the floor covering is comprised by spacer strips. A percentage such as 60%, in the range of 55% to 70% is further preferred. That is, if a plurality of tread strips are of a similar width, each assembly of spacer strips preferably has a width between 1.2 and 3.0, and preferably no more than 2.25 times that of a tread strip. A width such as 1.5 and preferably in the range of 1.35 to twice that of a tread strip is further preferred.

The invention envisages that each successive pair of tread strips shall be spaced by an assembly of three spacer strips, though other numbers such as two or four spacer strips could be provided. All spacer strips between a successive pair of tread strips may be of the same material which may be a metal such as aluminum or, for example, a plastics such as polyvinyl chloride or polypropylene.

Each successive pair of tread strips may be spaced by a combination of metal and plastics spacer strips, for example an assembly of a metal strip sandwiched between a pair of plastics strips.

The spacer strips between a successive pair of tread strips preferably are of two or more colours. In a preferred configuration of three strips a central spacer strip of aluminum, which may be of natural finish or anodised, may be sandwiched between two plastics strips of a colour which contrasts with the aluminum.

The spacer strips may be of the aforedescribed H or C cross-sectional shape, or of another substantially rigid form, typically hollow, A spacer strip may be arranged to have an upper wall which in use lies substantially horizontally and a depending wall connected to the upper wall, apertures being provided in the depending wall and the connecting means extending through said apertures in a configuration in which the connecting means restrain the upper wall from deforming downwardly to any substantial extent when a load is imposed thereon at least in the region of the connecting means. Examples of spacer strips of this type are described in more detail in Patent Specification GB-A-2090128A.

Two successive tread strips may be spaced by an assembly of three spacer strips each of a C shape in cross section, i.e. in use comprising a vertical wall from which upper and lower walls extend horizontally with the connecting means therebetween. The spacer strips may be arranged such that the free edges of the upper and lower walls of a central of the three strips abut similar confronting free edges of another spacer strip or abut the vertical wall of said another spacer strip.

An example of another suitable type of spacer strip, particularly for positioning adjacent a tread strip, is one comprising a pair of longitudinally extending and co-planar support faces to bear against and provide lateral support to a side face of a tread strip, the maximum spacing of extreme edges of said support faces as viewed in cross-section being less than the height of the side face of the tread strip whereby an assembly of at least two said spacer strips provides a recess region between a successive pair of tread strips. A spacer strip of this type is referred to herein as a supporting spacer strip.

The supporting spacer strips may be of a hollow, e.g. tubular shape, as considered in cross-section, and in that case the pair of support faces of a strip may be separated by a longitudinally extending slit. That slit may be dimensioned and positioned to allow the connecting means to extend therethrough. Alternatively the support faces may, for example, be contiguous, the apertures being provided for the connecting means.

The abutment supporting faces, as viewed in transverse cross-section of a supporting spacer strip, preferably each have a length of at least 15% and more preferably at least 25% of the height of the side face of a tread strip. The support faces are able thereby to provide useful lateral support to the relatively substantially resilient and flexible tread strips.

The supporting type spacer strips preferably have substantially planar distance faces which are parallel with and spaced from the associated support faces and arranged to contact the distance face of another spacer strip of a pair or another spacer element interposed between the two supporting spacer strips of a pair. An interposed spacer element may be of the H or C cross-sectional shape as described above. The distance faces preferably are provided with apertures through which the connecting means may extend.

It is preferred also that supporting type spacer strips each comprise a side face which lies inclined relative to the support faces, preferably orientated such that the thickness of the spacer strip reduces, as considered in cross-section, with increasing distance from its support faces. That side face preferably is one that faces generally upwardly in use of the floor covering; the spacer strip may have two inclined side faces so that the floor covering is reversible in use. Preferably the spacer strip is of a trapezoidal cross-sectional shape.

Two supporting spacer strips may be arranged directly in contact with one another between a pair of tread strips. They may be of a kind having planar distance faces spaced from the pairs of support faces, and may have said spacing determining distance faces directly in contact. Auxiliary spacer means may be provided between a pair of tread strips.

Auxiliary spacer means may be longitudinally continuous and be shaped for longitudinally continuous contact with the distance faces, e.g. a strip of H or C cross-sectional shape. The auxiliary spacer means alternatively may be profiled along its length or may comprise a plurality of discrete spacer elements whereby the floor covering is provided with openings through which dirt or water may pass.

If the auxiliary spacer means comprises discrete spacer elements, said elements may be apertured for location on and support by the connecting means of the floor covering.

The auxiliary spacer means, as viewed in cross-section of the floor covering, preferably has a height in the range 40% to 90%, more preferably 50% to 75%, of the height of neighbouring tread strips.

The tread strips may be of known kind as described in herein and having an embedded reinforcement. However the lateral support provided by the support faces of the spacer strips of the floor covering of the present invention allow alternatively the use of tread strips of other constructions and which per se are transversely relatively less rigid or resistant to deformation.

The tread strips may, for example, comprise felt material. Two or more layers of felt may be provided in a strip and said layers may lie substantially parallel with the plane of the floor covering, i.e. substantially perpendicular relative to said pairs of support faces of the spacer strips.

The assembly of spacer strips between a pair of successive tread strips preferably lies recessed, i.e. below the fibrous tread surfaces of the tread strips. The assembly of spacer strips preferably provides a ribbed surface at the base of said recess to assist wiping action.

The assembly of spacer strips between a pair of successive tread strips may comprise strips which are all longitudinally continuous and in continuous abutment with neighbouring spacer and/or tread strips to provide a non-apertured floor covering.

BRIEF DESCRIPTION OF THE DRAWINGS

Embodiments of the present invention will now be described, by way of example, with reference to the Drawings, in which.

DETAILED DESCRIPTION OF THE INVENTION

Figure 1:
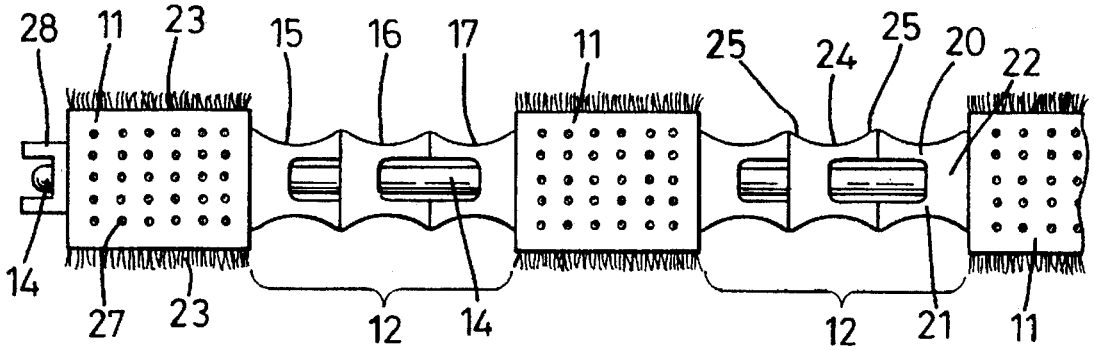
FIG. 1 is an end view of part of an entrance mat of the invention.
Figure 2:
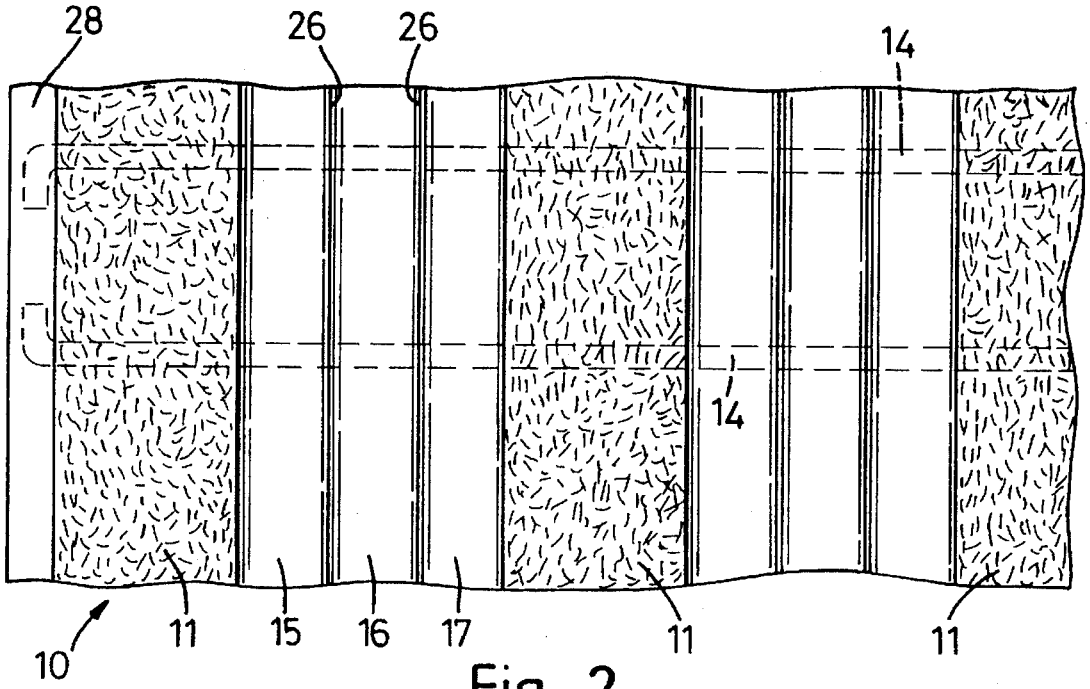
FIG. 2 is a plan view of the mat of FIG. 1.

A floor covering for use as an entrance mat 10 comprises a plurality of relatively substantially resilient tread strips 11 and a plurality of relatively substantially rigid spacer strip assemblies 12 arranged with each neighbouring pair of tread strips spaced by a spacer strip assembly 12. The tread strips and spacer strip assemblies are held together against transverse separation by transversely extending high tensile steel connecting wires 14 which extend through apertures provided therefor in the strips.

Each spacer strip assembly 12 comprises three longitudinally continuous and extruded type spacer strips 15, 16, 17 each of a corresponding and substantially C shaped cross-section. A central one 16 of the three spacer strips is of aluminum and the other two spacer strips 15, 17 are of polyvinyl chloride. The two plastics strips 15, 17 are of an identical colour which in this embodiment is chosen to contrast with the aluminum strip 16. The three spacer strips 15,16,17 are each of the same width, which is in the order of half the tread strip width. The spacer strip assembly 12 therefore has a width of approximately 1.5 times that of the tread strip.

Each spacer strip 15, 16, 17 of C shaped cross-section comprises an upper wall 20 which in use lies substantially horizontally, a lower wall 21 which in use also lies substantially horizontally, and a depending wall 22 which is integral with and interconnects the upper and lower walls 20, 21. The depending wall 22 in use extends substantially vertically and is provided with apertures through which the connecting wires 14 extend. The spacing of the upper and lower walls is only slightly greater than the diameter of the connecting wires so that in use the wires 14 provide support for the uppermost walls both when the mat is used in the orientation of FIG. 1 or when reversed.

Each upper and lower wall 20, 21 of the spacer strips 15, 16, 17 has an outwardly facing surface 24 which is troughed in cross-section so that rib-like formations 25 are formed at the longitudinal edges of the surfaces 24.

In the construction shown in FIG. 1 the free ends of the upper and lower walls of the spacer strips 15 and 16 respectively abut a vertical wall 22 of the spacer strip 16 and free ends of the upper and lower walls 20, 21 of the spacer strip 17. The adjacent rib-like formations 25 of the neighbouring strips 15 and 16 and of the neighbouring strips 16, 17 cooperate to provide a pair of rib formations 26 between each successive pair of tread strips 11.

The spacer strips 15, 16, 17 have a smaller thickness than the tread strips 11 as viewed in FIG. 1 and are symmetrically located by the connecting wires 14 such that at each of its upper and lower walls 20, 21 the spacer strip surfaces 24 lie recessed relative to the outer, wear surfaces 23 of the tread strips.

The tread strips 11 each comprise a body of rubber having layers 27 of nylon reinforcement embedded therein and arranged to extend vertically as shown in FIG. 1. Upper and lower outer surfaces of the rubber body are buffed to expose the nylon fibre material so that it provides a wiping surface 23 as is well known.

Figure 3:
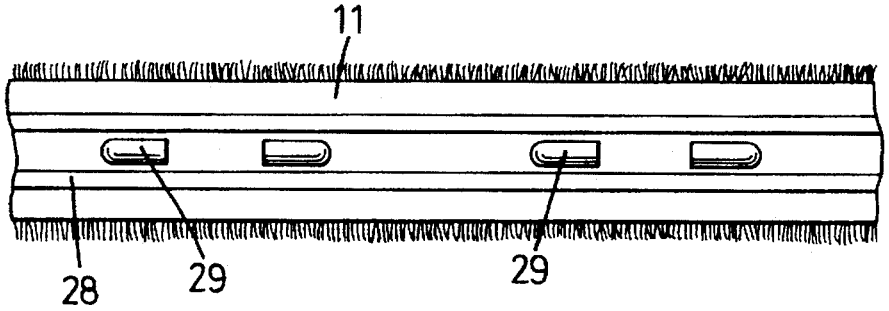
FIG. 3 is a side view of the mat of FIG. 1.

The mat 10 has a pair of outer rigid edge strips 28 which locate the connecting wires 14. The connecting wires are of U configuration, the ends 29 of the U being passed through aligned apertures in the respective strips and then bent against an edge strip to provide transverse retention of the strips in contact with one another as shown in FIG. 3.

Figure 4:
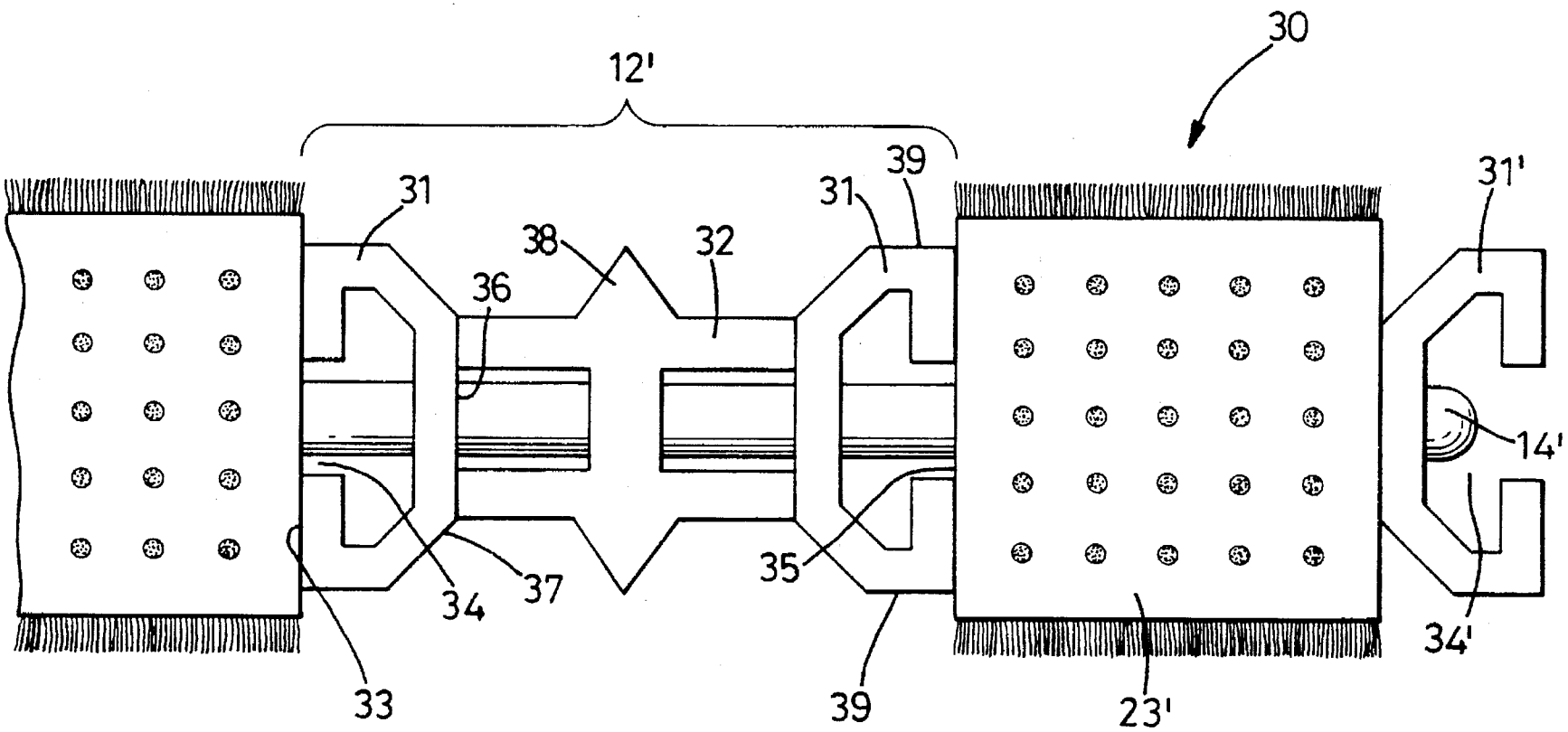
FIG. 4 is an end view of part of another entrance mat of the invention.

In the construction 30 shown in FIG. 4 the tread strips 23' and connecting wires 14' are as described above, but the spacer strip assembly 12' is of a different construction.

The spacer strip assembly 12' comprises two support type spacer strips 31 and an H section spacer strip 32 interposed therebetween.

Each support type spacer strip 31 is of a hollow, substantially tubular form of extruded PVC. It comprises a pair of co-planar support faces 33 which are separated by a longitudinally extending slit 34. The support faces 33 are arranged to abut against a side face 35 of a tread strip. In this embodiment each support face, as viewed in FIG. 4, has a height of approximately 30% of the height, i.e. vertical thickness, of the tread strip 23' and the overall spacing of the extremities of the support faces, i.e. the height of the spacer strip in the plane of the support faces, is approximately 80% of the height of the tread strips.

Each support type spacer strip 31 is of a generally trapezoidal cross section, with inclined faces 37, and at a position remote from the side containing the support faces 33 it has a distance face 36.

The distance faces 36 of a pair of spacer strips are maintained separated but confronting one another by the aforementioned H-section spacer strip 32.

The outer side faces of the outermost tread strips are abutted by spacer strips 31' of a reverse orientation. That is, the distance face of a strip 31' abuts the central region of a side of a tread strip. By virtue of the reverse orientation the slits 34' in the edge spacer strips 31' allow the hollow region of the strip to accommodate a bent portion of a transverse connecting wire 14'.

The H-section strip 32 is provided with lengthwise extending ribs 38. The apex of each rib lies co-planar with upper and lower surfaces 39 of the adjacent support type spacer strips.

In this embodiment the spacer strip assembly 12' has a width which is approximately 2.25 times the tread strip width.

I claim:

1. A floor covering comprising a plurality of tread strips of substantially resilient and flexible material having an embedded reinforcement each tread strip having a wear layer of a material which provides a fibrous tread surface, and a plurality of spacer strips of substantially rigid material arranged interposed between successive pairs of the tread strips wherein successive pairs of tread strips are spaced apart by an assembly of at least three of said spacer strips arranged side-by-side and the pluralities of strips being secured together in side-by-side relationship by connecting means which pass through aligned apertures in the spacer strips and in the resilient and flexible material of the tread strips.

2. A floor covering according to claim 1 wherein between 55 and 75% of the area of the floor covering is comprised by spacer strips.

3. A floor covering according to claim 1 wherein between 55 and 70% of the area of the floor covering is comprised by spacer strips.

4. A floor covering according to claim 1 wherein the tread strips of the plurality of tread strips are of a similar width and an assembly of said spacer strips has a width between 1.2 and 3.0 times the width of a tread strip.

5. A floor covering according to claim 1 wherein said assembly of at least three of said spacer strips has a width no more than 2.25 times the width of a tread strip.

6. A floor covering according to claim 1 wherein each successive pair of tread strips is spaced by a combination of at least one metal spacer strip and at least one plastics spacer strip.

7. A floor covering according to claim 6 wherein a successive pair of tread strips is spaced by two plastics strips having a metal strip sandwiched therebetween.

8. A floor covering according to claim 1 wherein two spacer strips between a successive pair of tread strips are of different colors.

9. A floor covering according to claim 1 wherein at least one of said plurality of spacer strips comprises an upper wall which in use lies substantially horizontally and a depending wall connected to the upper wall, wherein apertures are provided in the depending wall and the connecting means extend through said apertures in a configuration in which the connecting means restrains the upper wall from deforming downwardly to any substantial extent when a load is imposed thereon.

10. A floor covering according to claim 1 wherein at least one of said plurality of spacer strips has a C-shaped cross-section, said cross-section being defined by a vertical wall from which upper and lower walls extend horizontally and terminate in free edges with the connecting means therebetween.

11. A floor covering according to claim 10 wherein two successive tread strips are spaced apart by an assembly of three spacer strips with one spacer strip being located centrally of the others, said centrally located strip being C-shaped in cross-section, the three spacer strips being arranged such that the free edges of the upper and lower walls of said centrally located C-shaped strip abut similar confronting free edges of another spacer strip or abut the vertical wall of said another spacer strip.

12. A floor covering according to claim 1 wherein the floor covering has a predetermined thickness and wherein one of said assembly of at least three spacer strips has an H-shaped cross-section with the cross-piece of the H extending in the direction of the thickness of the floor covering.

13. A floor covering according to claim 1 wherein one of said assembly of at least three spacer strips has a predetermined structure comprising a pair of longitudinally extending and co-planar support faces to bear against and provide lateral support to a side face of a tread strip.

14. A floor covering according to claim 13 wherein said spacer strip of predetermined structure comprises a side face which lies inclined relative to the support faces.

15. A floor covering according to claim 14 wherein said spacer strip of predetermined structure is of a substantially trapezoidal cross-sectional shape.

16. A floor covering according to claim 1 and additionally comprising auxiliary spacer means provided between a pair of tread strips, said auxiliary spacer means being shaped along its length or comprising a plurality of discrete spacer elements so that the floor covering is provided with openings through which dirt or water may pass.

17. A floor covering according to claim 16 wherein the auxiliary spacer means, as viewed in cross-section of the floor covering, has a height in the range 40% to 90% of the height of neighbouring tread strips.

18. A floor covering according to claim 1 wherein tread strips comprise felt material.

19. A floor covering according to claim 1 wherein the reinforcement material of at least one of said plurality of tread strips of said substantially resilient and flexible material provides said fibrous tread surface.

20. A floor covering according to claim 1 wherein an assembly of spacer strips between a pair of successive tread strips lies recessed, below the fibrous tread surfaces of the tread strips.

21. A floor covering according to claim 20 wherein the assembly of spacer strips between a pair of successive tread strips provides a ribbed surface at the base of said recess.

* * * * *